US005705981A

United States Patent [19]

Goldman

[11] Patent Number: 5,705,981

[45] Date of Patent: Jan. 6, 1998

[54] SECURE ENCLOSURE WITH CONTINUOUS MONITORING

[75] Inventor: Robert B. Goldman, Evanston, Ill.

[73] Assignee: Breed Automotive Technology, Inc., Lakeland, Fla.

[21] Appl. No.: 617,509

[22] Filed: Mar. 15, 1996

[51] Int. Cl.[6] ..... G08B 13/06

[52] U.S. Cl. ..... 340/541; 340/550; 340/665

[58] Field of Search ..... 340/541, 665, 340/550

[56] References Cited

U.S. PATENT DOCUMENTS

| | | | |
|---|---|---|---|
| 398,272 | 9/1889 | Weston | 340/541 |
| 4,745,301 | 5/1988 | Michalchik | 307/119 |
| 4,763,534 | 8/1988 | Hager | 73/862.68 |
| 5,121,929 | 6/1992 | Cobb | 277/2 |
| 5,222,399 | 6/1993 | Kropp | 73/862.68 |
| 5,224,430 | 7/1993 | MacPherson | 340/550 |
| 5,431,064 | 7/1995 | Franz | 73/862.68 |
| 5,506,566 | 4/1996 | Oldfield et al. | 340/550 |

FOREIGN PATENT DOCUMENTS

| | | |
|---|---|---|
| 0 582 733 A1 | 2/1994 | European Pat. Off. . |
| 87 00 011.3 U | 6/1987 | Germany . |

*Primary Examiner*—Glen Swann

*Attorney, Agent, or Firm*—Laff, Whitesel, Conte & Saret, Ltd.

[57] ABSTRACT

A load sensing assembly for sensing loads applied at a plurality of spaced locations around the perimeter of a closure employs a plurality of spaced load sensors disposed on a substrate, with one of the load sensors adapted to be positioned proximate each of the spaced locations, and a layer of a compliant elastomeric material disposed on the sensing assembly and overlying each load sensor.

23 Claims, 5 Drawing Sheets

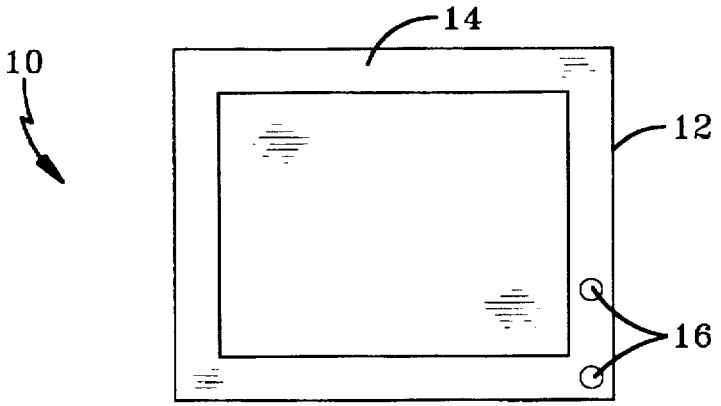
FIG-1
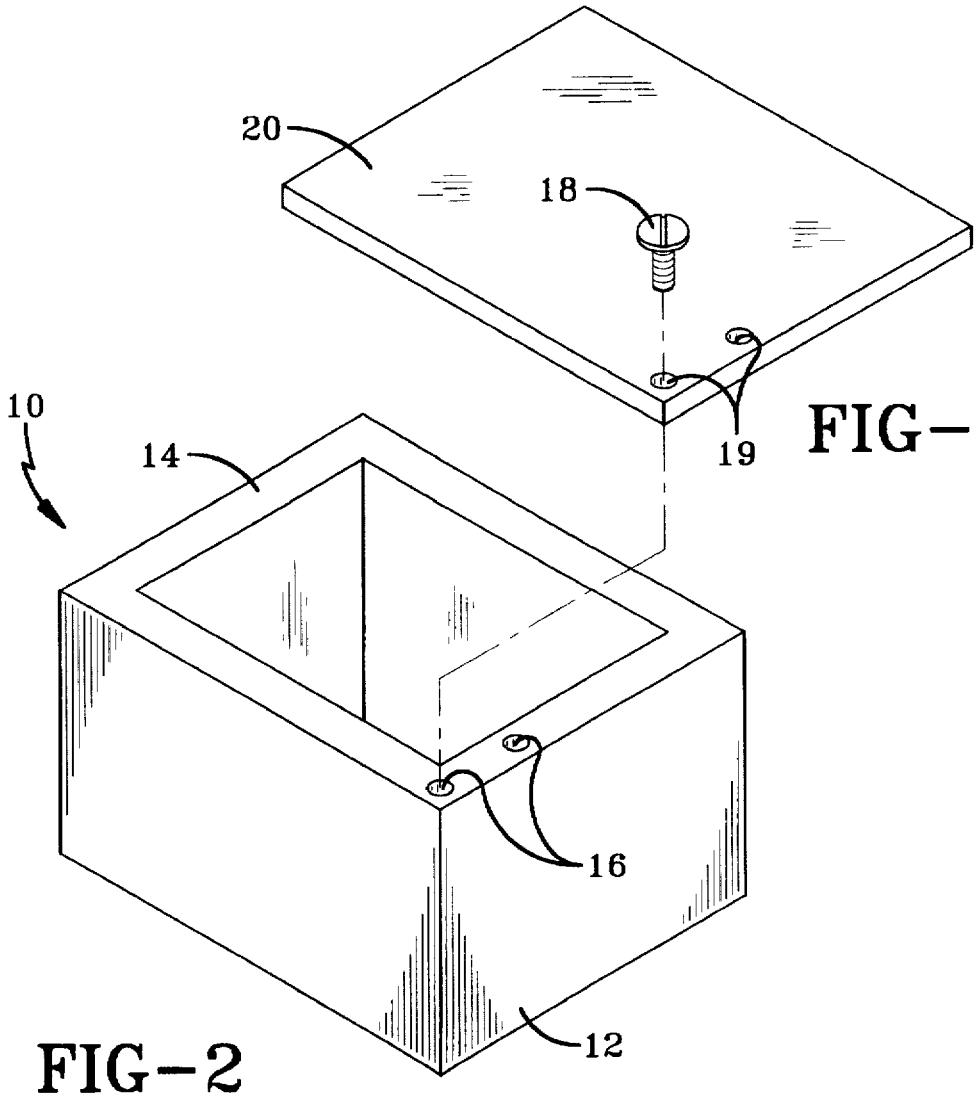
FIG-3
FIG-2

SECURE ENCLOSURE WITH CONTINUOUS MONITORING

FIELD OF TEE INVENTION

This invention relates generally to tamper detection for an enclosure and in particular to tamper detection through the use of load sensors, and is more particularly directed toward a secure enclosure employing pressure sensitive load sensors that are continuously monitored for indications of tampering.

BACKGROUND OF THE INVENTION

For reasons of safety or security, it is frequently desirable to know when a closure such as a lid or cover for a container or an access hatch is being or has been tampered with. Various approaches to monitoring such lids, covers, and access hatches have been used, but, for a variety of reasons, they are neither as failsafe nor as reliable as is desirable. Therefore, an improved system for continuously monitoring a closure to detect tampering is still needed.

One monitoring system for a closure has proposed the use of pressure sensors distributed along the perimeter of the closure. The expectation was that if a sensor experienced a change in the applied load, that would signify tampering or an attempt to tamper. For example, if a fastener or clip provided the clamp load between the closure, such as a cover, and the enclosure body, and the closure was loosened or removed, the applied compressive pressure to one or more of the sensing elements would be reduced, the resistance of the load sensor would increase and the monitoring electronics would then regard that change as an apparent attempt to breach the closure, and an alarm or other desired signal would be produced.

Although theoretically any change in load applied such as that resulting from tightening or loosening the clamping load can be sensed by an associated monitoring system, especially where there is a large number of points at which such monitoring is desired, where the clamping loads may be widely different at each of a plurality of the points, or where the ambient temperature conditions vary widely or are elevated, the mere introduction of a series of pressure sensitive load sensors along the perimeter of the closure is not currently a satisfactory solution in any practical sense.

Thus, it is an object of the present invention to provide a monitoring system using pressure sensitive load sensors which are multiplexed to a single electronic monitoring module, so that a single monitoring module may be used, rather than using one for each of the multiple individual locations to be monitored, and which are adapted to make the pressure distribution at the several locations to be more uniform.

SUMMARY OF THE INVENTION

These needs and others are satisfied by the present invention, in which a pressure sensitive load sensing assembly is provided for sensing loads applied at a plurality of spaced locations around the perimeter of a closure. The load sensing assembly comprises a plurality of spaced load sensors disposed on a substrate, with one of the load sensors adapted to be positioned proximate each of the spaced locations, and a layer of a compliant elastomeric material disposed on the sensing assembly and overlying each load sensor. In one form the layer of compliant material is disposed on the substrate in a continuous layer. Each of the plurality of load sensors preferably comprises a pair of electrodes and a body of pressure sensitive resistive material between them. In one form the assembly comprises a pair of insulative substrates and a first electrode of each pair is disposed on the inner surface of a first of the insulative substrates, and a second electrode of each pair is disposed on an inner surface of the second insulative substrate. In a preferred form a common conductive trace connects all of the first electrodes to a common terminal, and separate conductive traces connect each of the second electrodes to separate terminals. The layer of compliant elastomeric material is desirably disposed on an outer surface of one of the substrates and overlies each of the load sensors.

A preferred pressure sensitive load sensing assembly for sensing loads applied at a plurality of spaced locations around the perimeter of a closure in accordance with the present invention comprises a plurality of spaced pressure sensitive load sensors, one for each of the spaced locations, each load sensor comprising a pair of electrodes and a body of pressure sensitive resistive material between them, one electrode of each pair being on the inner surface of a first insulative substrate and the second electrode of each pair being on an inner surface of a second insulative substrate, a common conductive trace connecting all of the first electrodes, and separate conductive traces for each of the second electrodes, and a terminal for each of the traces, and a layer of a compliant elastomeric material disposed on an outer surface of one of the substrates and overlying each of the load sensors. Desirably, the first and second insulative substrates comprise plastic polyimide substrates and the compliant elastomeric layer comprises a high-temperature resistant silicone rubber which is substantially coextensive with the insulative substrates. In a preferred form the load sensing assembly has a thickness of about 0.010 inch to about 0.025 inch, with the compliant elastomeric material having a thickness of from about 0.005 inch to about 0.020 inch. In one form each of the second electrodes is a discrete portion of a common conductive trace, the common trace being deposited on the inner surface of the second substrate.

Further objects, features, and advantages of the present invention will become apparent from the following description and drawings.

BRIEF DESCRIPTION OF THE DRAWINGS

FIG. 1 is a plan view of an enclosure adapted to be monitored by a sensing assembly of the present invention;

FIG. 2 is a perspective view of the enclosure of FIG. 1;

FIG. 3 is a perspective view of a cover for the enclosure of FIGS. 1 and 2;

DETAILED DESCRIPTION

Figure 4:
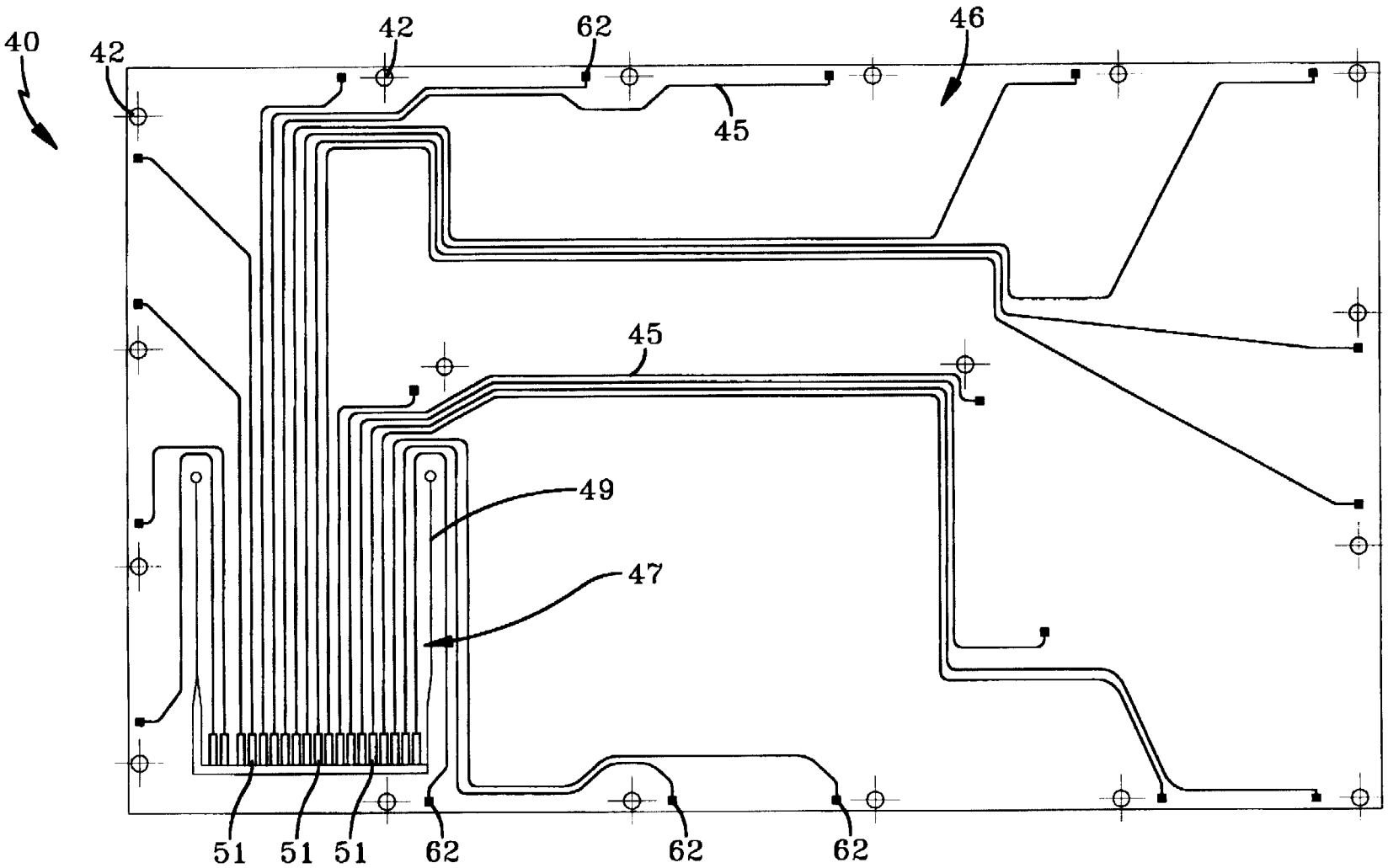
FIG. 4 is a plan view of a first substrate of a sensing assembly of FIG. 6 of the present invention.
Figure 5:
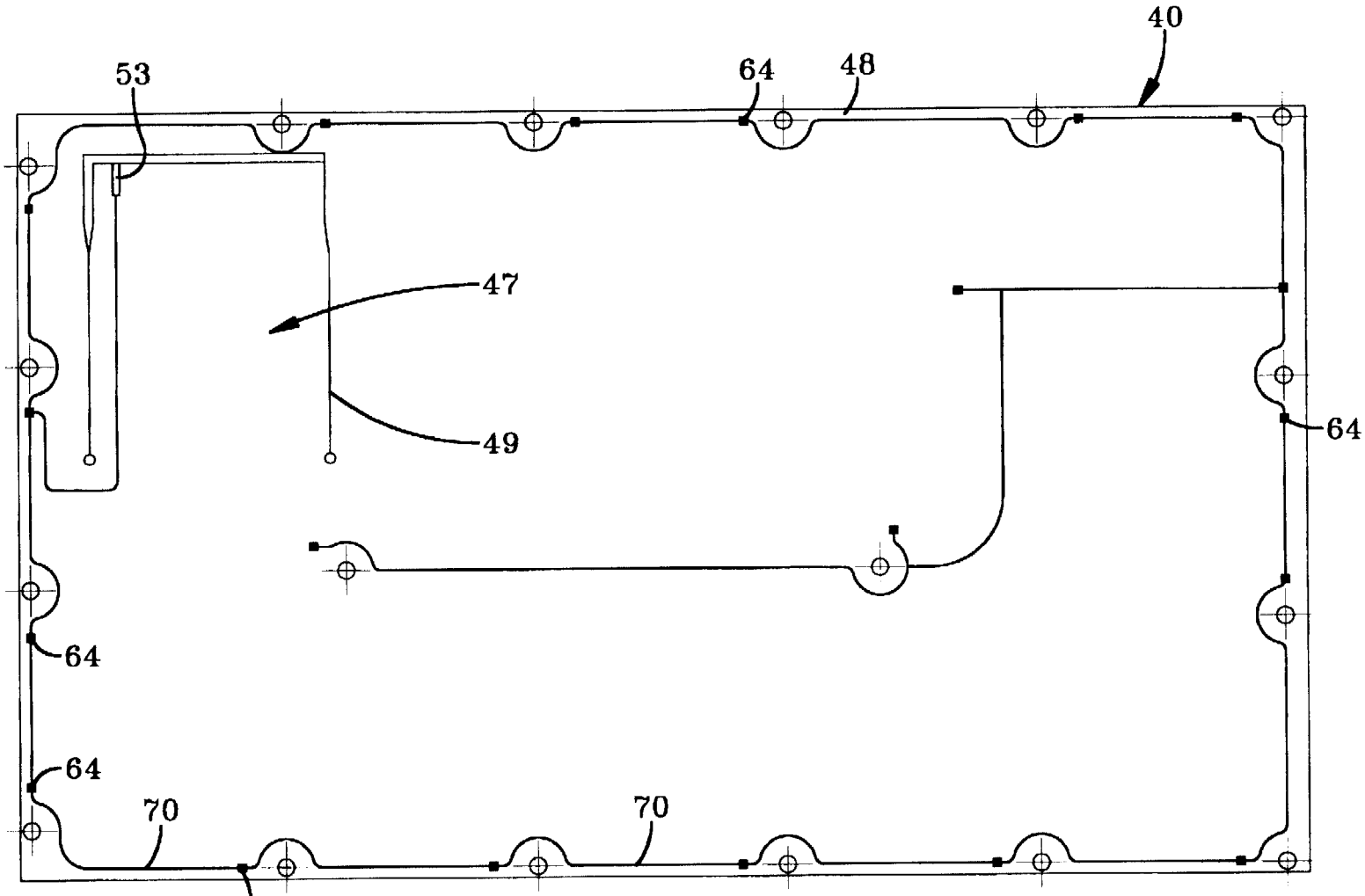
FIG. 5 is a plan view of a second substrate of a sensing assembly of FIG. 6 of the present invention.

In accordance with the present invention, a secure enclosure with continuous monitoring is described that provides distinct advantages when compared to those of the prior art.

In a presently preferred embodiment of the present invention, an enclosure 10 (FIGS. 1–3) such as a container is provided. The enclosure may have an exterior wall 12, with a top flange 14. The enclosure may also have one or more interior walls (not shown). The flange 14 may have a width of ⅞ to ½ inch and is adapted to receive threaded fasteners 18 in fastener openings 16 for securing a cover 20 to the enclosure.

The enclosure 10 may be of any suitable material, such as cast aluminum, and the cover 20 may be of the same material. The wall thicknesses of the enclosure and cover may be about ⅛", although other dimensions may be used as well.

Figure 6:
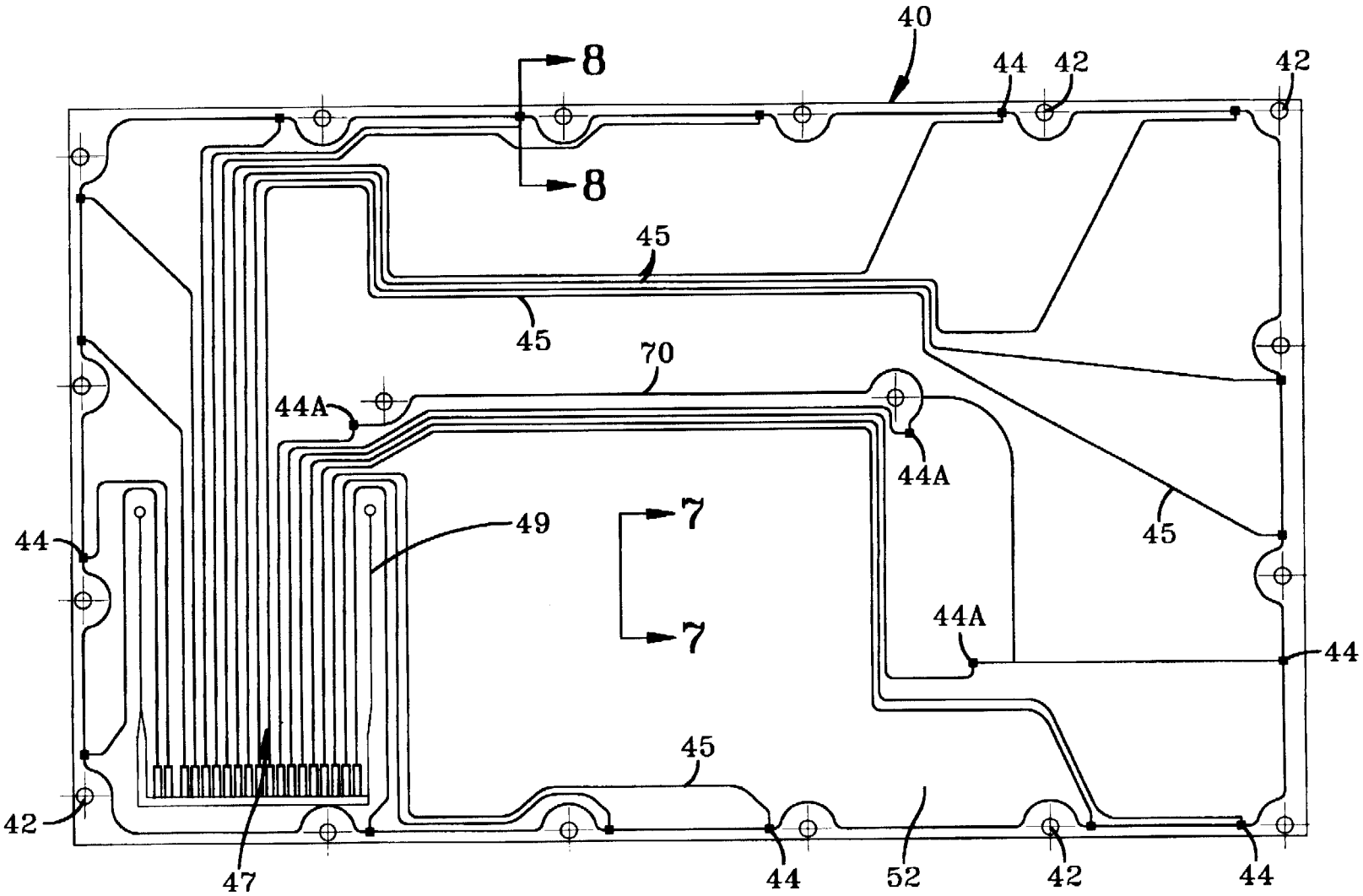
FIG. 6 is a plan view of a sensing assembly of the present invention.
Figure 7:
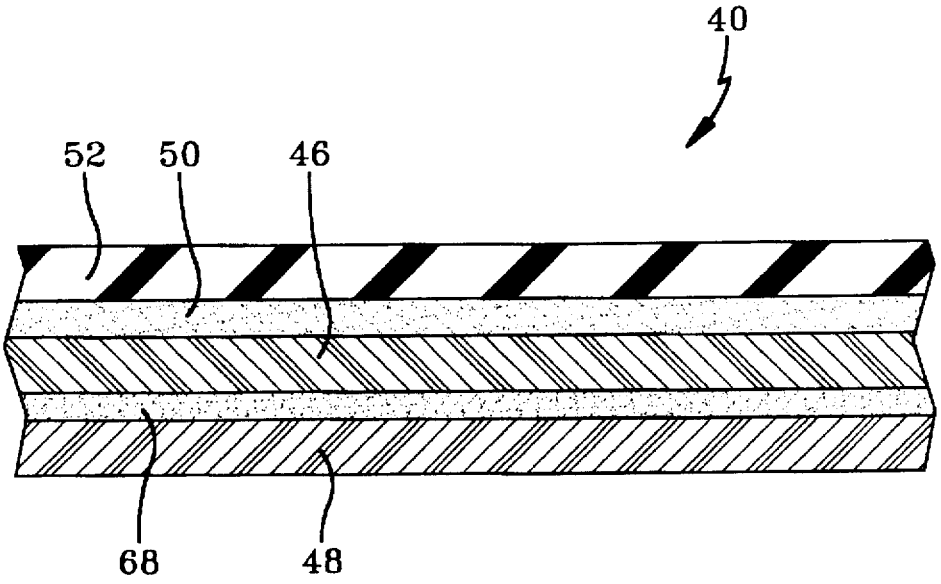
FIG. 7 is an enlarged representational cross-sectional view of the sensing assembly of FIG. 6 taken generally at location 7—7.

In accordance with the present invention, the enclosure 10 is fitted with a sensing assembly 40 (FIGS. 4–8) that is adapted to provide a signal indicative of tampering or of possible attempted access to the enclosure. A variety of responses to such a signal may be employed. Sensing assembly 40 includes a plurality of pressure sensitive load sensors 44 (FIG. 6), each of which may provide a signal at its location for indicating tampering thereat.

For reasons of security or safety, it is desirable to know if the cover 20 of the enclosure 10 is being or has been tampered with. Sandwiching a sensing assembly 40 between the enclosure 10 and the cover 20 provides an effective means for continuous monitoring of the physical enclosure 10 for tampering. When the pressure sensitive load sensors 44 are compressed, the resistances of the sensors 44 are reduced so that they become relatively conductive. When the cover 20 is securely attached to the enclosure 10 (torqued down), the resistances of all sensors 44 are reduced and are ideally below a prescribed resistance level or threshold. If fasteners such as screws 18 providing the clamp load between the cover 20 and the enclosure body 10 are loosened or removed at one or more locations, the applied compressive load at the locations of one or more sensors 44 will be reduced and the resistance of the sensors 44 at those locations will increase dramatically. This change in resistance will signify that tampering may be occurring and that access to the "secure" enclosure 10 may have occurred.

Through any number of electrical means, it is possible to monitor the resistance of each sensor 44 and determine if the enclosure is being or may have been tampered with, by looking for an increase in the sensor resistance beyond a predetermined "alarm" threshold. This monitoring is achievable, for example, through a microprocessor-controlled electronic module of Conventional design, including an analog multiplexer for selection of the appropriate sensor 44, precision measurement circuitry, such as an analog-to-digital converter (A/D), and an associated precision voltage divider, current source, and/or bridge network, all of which are well-known in the art.

The assembly 40 is designed to be interposed between the top cover 20 and the enclosure 10. The cover is secured to the enclosure by a plurality of fasteners 18, which may be conventional screws. The screws preferably fit through openings 19 in the cover 20 and engage threaded openings 16 in the flange 14. The presence of the sensing assembly may be "hidden" if the perimeter of the assembly 40 and the associated connectors are all within the perimeters of the cover and enclosure.

The sensing assembly 40 may be of the same general size and shape as the top cover 20 of the enclosure 10. In the preferred embodiment, the actual dimensions are approximately 12.25"×7.5". A plurality of openings 42 are provided in the sensing assembly 40 to accommodate the fasteners 18 used to secure the cover 20. In proximity (such as ⅜" away) to each such opening 42, a sensor 44 is disposed. Preferably each sensor 44 is spaced the same distance from its adjacent opening 16 so that similar changes in loads, such as those resulting from a one-quarter turn of a screw 18 will tend to produce a change in resistance which is similar to that resulting from a one-quarter turn of other screws adjacent their sensors 44.

Each of the sensors 44 of sensing assembly 40 includes a first electrode 62 of generally rectangular shape (see FIG. 4). These first electrodes 62 are preferably formed by deposition of conductive ink on a relatively thin, first substrate 46, which may be formed of plastic and may be transparent. Individual conductive traces 45, also preferably formed from conductive ink, provide electrical contact between the electrodes and the connector pigtail region 47, in this instance one that is free to bend out of the plane of the sensing assembly 40 by virtue of die cut 49. A second substrate 48 (FIG. 5) of the same general shape and material as the first substrate 46 includes a plurality of mating confronting second electrodes 64 joined by a single common conductive trace 70 which terminates at the pigtail region 47. Pigtail region 47 provides terminals 51 for traces 45 and a terminal 53 for trace 70.

Figure 8:
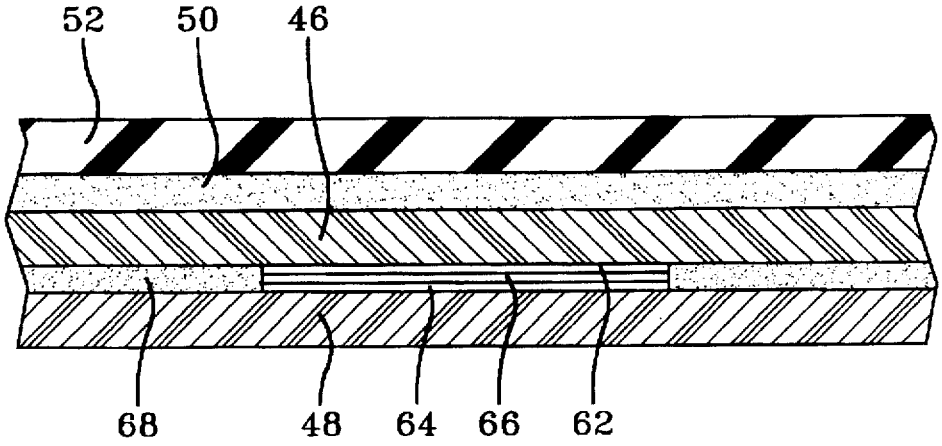
FIG. 8 is an enlarged representational cross-section view of the sensing assembly of FIG. 6 taken generally at the location 8—8.

Preferably (as seen in FIG. 8), a pressure Sensitive resistive material 66 is interposed between the pairs of confronting electrodes 62, 64 to form each sensor 44. The pressure sensitive material may desirably be a thin layer deposited on each of the confronting electrode surfaces. The first and second substrates are bonded together by an adhesive layer 68 which is provided around the electrodes 62, 64, forming a sandwich structure of pressure sensitive resistive load sensing bodies comprising sensors 44. The thickness of this sandwich structure alone is about 0.003 inch. Of course, other sensor configurations may also be used. For example, the sensor may be disposed on a single substrate, with pressure sensitive material bridging and overlying laterally positioned electrodes.

Importantly, the sensing assembly 40 also comprises a layer of compliant, elastomeric material 52 on the outer surface of one of the substrates 46, 48. The compliant, elastomeric material 52 is bonded to the sensing assembly 40 by a layer of adhesive material 50.

In a preferred embodiment, the compliant material 52 is a high temperature silicone rubber manufactured by Bisco Products of Elk Grove Village, Ill., identified as HT-6135 Solid Silicone Rubber. The thickness is nominally 0.010 inch and the durometer is 30–40 Shore "A".

The adhesive 50 used to attach the sensor 40 to the compliant material 52 is preferably a silicone based high-temperature adhesive from Dielectric Polymers, Inc. of Holyoke, Mass. The product is Tran-Sil® NT-1001 Silicone Transfer Adhesive. The adhesive 50 is about 0.002 inches thick.

In the preferred embodiment (FIG. 6), the sensing assembly 40 has nineteen sensors 44, one for each of the fasteners 18 used in the exemplary enclosure and cover assembly. Sixteen of the sensors 44 are at the perimeter. Three of the sensors 44A are located internally and may be used at interior walls (not shown). The total thickness of the sensing assembly 40 is about 0.015 inch. Most preferably the total thickness of the sensing assembly 40 is from about 0.010 inch to about 0.025 inch and the compliant elastomeric layer has a thickness of from about 0.005 inch to about 0.020 inch.

Both of the first 46 and second 48 substrates used in construction of the sensing assembly 40 are preferably about 0.001 inch polyimide plastic sheets (preferably Kapton, available from DuPont Company) that has been treated with a Chemlok® 607 Bonding Agent to improve adhesion of the printed conductive inks. The conductive ink may be a suspension of silver powder and/or flakes in a high temperature binder system. The particle content must be sufficient to provide a conductive path through the dried ink film. An example of such a composition is Matrimide 5218, a polyimide binder, 15 grams; silver flakes, 84 grams; and acetophenone, 85 grams. The mixture is diluted to a suitable consistency for screening. Matrimide 5218 is available from Ciba-Geigy Corporation, the silver flakes may be obtained from DuPont Company as K003L and have a surface area of 0.7 to 1.25 square meters per gram. This particular ink is usable up to a temperature of about 150° C. Other binders suitable for use at high temperatures are phenolic and specially formulated epoxies.

The high temperature, pressure sensitive resistive material (force ink) used in this embodiment was prepared from the following ingredients: Superfine $MoS_2$—165 grams (0.4 micron by the Fisher method), finely ground silica—56 grams (Minusil 5 from Summit Chemical having a particle size of 1.5 micron), a polyimide binder—28 grams (Matrimide 5218 from Ciba-Geigy), and a solvent for depositing the ink. The solvent may be acetophenone (186 grams) and cyclohexanone (18 grams).

The unique construction of the sensing assembly of the present invention comprises multiple sensors 44 which are multiplexed to a single electronic monitoring module. The sensing assembly is connected through mechanical means to the electronic monitoring module (for example, using Berg Clincher™ type connectors, ZIF or zero insertion force connectors, or heat seal connectors). Because a single electronic module is used to measure the load at all sensors 44 of the sensing assembly 40, it is desirable that all of the sensors 44, when the sensing assembly is assembled in the proper secure configuration, have applied resistance levels that are in the same approximate range; that is, the maximum ratio between largest and smallest value is about 2:1.

Because of small differences in flange and confronting cover spacings and other ambient conditions, a sensing assembly installed between a cover and an enclosure will typically have widely varying compressive stresses which are applied to the sensor. Typically this would result in widely varying resistance levels which would be produced by like sensors exposed to such widely varying stresses. This would tend to render a single electronics module useless in monitoring more than one sensor 44. However, it was discovered that by utilizing a compliant, resilient material at each of the sensing zones, the variations in resistance levels resulting from widely varying compressive stresses are substantially reduced, and, for example, that as little as a ¼ turn of a fastening screw at one location can be discerned satisfactorily, even where compressive loads applied at various of the sensor 44 locations vary widely. Simply interposing a pressure sensitive load sensor at each location would not provide for such discrimination if only load sensors without the compliant layer were used.

Uneven pressure distribution between the cover and the enclosure can be caused by physical damage to the flange surfaces (nicks, gouges, pitting, scale, rust, etc.), non-parallel flanges, variation in distance from a fastener or hinge, and differences in local stiffness of the cover and/or enclosure itself. It is such impediments to the effective use of a plurality of load sensors and particularly multiplexed pressure sensitive load sensors which are effectively eliminated in accordance with the present invention.

The use of a thin compliant material appropriately chosen for the given design parameters of the cover/enclosure assembly will cause the loading of the plurality of sensors around the cover/enclosure interface opening to be more uniform. Proper selection of the compliant material will allow a single electronics module to multiplex across all of the sensors, thus allowing the monitoring of each point for a change in resistance to signify that the cover is being tampered with.

Without a compliant material used in conjunction with the sensors described, the resistance values measured at each sensor may vary widely, as described above. This is at least partly due to the fact that it is inconvenient to specify, or achieve, an exact tightening torque for or at each fastener, and because the relative stiffness, smoothness and geometric relationships of the mating surfaces in proximity to the sensors cannot be guaranteed to be uniform.

Under these conditions, and without the compliant material, one sensor could display a resistance of 100 ohms when its associated fastener is securely tightened, while a sensor associated with a nearby fastener could display a resistance of say 100,000 ohms when its associated fastener is tightened. Clearly, under the conditions described, it would be difficult for the electronic module that monitors sensor resistance to discern between fasteners that are effectively secured and those that have been loosened, without exhaustive calibration of each fastener to determine the resistance value when the fastener is secure versus the resistance value when the fastener has been loosened.

Since an object of the present invention is to provide a continuous monitoring system for a secure enclosure that is reliable, cost effective, and relatively easy to implement, achieving relative uniformity of sensor resistance values is important in an effort to eliminate the need for individual sensor calibration. When the compliant material discussed above is used in the vicinity of each sensor, the average resistance value for all sensors may be about 200,000 ohms, with the maximum ratio between largest and smallest values being about 2:1. When a fastener is loosened about ¼ turn from its securely tightened state, the resistance ratio between the sensor proximate to the loosened fastener and the remaining sensors is typically greater than 100:1, with absolute resistance readings for sensors in proximity to loosened fasteners generally exceeding $30\times10^6$ ohms.

Under these conditions, where sensor resistance values have been rendered much more uniform by virtue of the compliant material, it is much easier to select an effective alarm threshold value for the electronic module that monitors sensor states, both if the sensors are multiplexed with one common trace or if the sensing assembly is one in which the sensors are each provided with a pair of separate traces.

Once an "alarm" condition is detected, it is possible through commonly available electronic means to sound an audible alarm, a visual alarm, a remote alarm or to zeroize (erase) sensitive information contained in the enclosure.

In addition to the general mechanical construction of the invention, a practical tamper detecting sensing assembly must be able to withstand a wide variety of environmental conditions without the device failing (becoming inoperative or indicating a false alarm condition). These environmental conditions can include high and low temperatures, humidity, shock, and vibration. It is therefore desirable to have each of the components used in the manufacture of the device, as well as the device as a whole, be able to withstand such environmental conditions. The desired operating temperature range for the particular sensing assembly described is from −40° C. to 85° C.

In security applications, it is sometimes possible to defeat physical security devices by exposing a secure enclosure to either extreme cold or extreme heat. This can often be accomplished as by spraying liquid nitrogen over a localized portion of the enclosure in an effort to super-cool the enclosure in a local area. Likewise, it is possible to superheat a local area of an enclosure by applying a hot flame or a heat gun to a local area.

Because of the nature of the semi-conductive materials used in the construction of the sensors of the sensing assembly, the resistance of each sensor is also affected by the temperature of the element. It is therefore also possible to detect, for a particular implementation of the present invention, localized overheating or overcooling conditions when the assembly is properly secured. That is, where a properly secured cover is in place and a sensor is superheated, the resistance of that sensor will decrease below a prescribed threshold resistance level indicating either that an apparent attempt to tamper is occurring or that a high heat source (higher than the operating temperature limits) has been applied. The appropriate alarm conditions can then be enacted. Likewise, if a properly secure assembly is locally cooled below its normal operating temperature, the resistance of the cooled sensor will increase beyond a prescribed limit indicating, again, an alarm condition. In this way, two unique tamper modes (physically loosening or removing fasteners, and applying localized heating or cooling) can be monitored with the present invention.

There has been described herein a secure enclosure with continuous monitoring that is relatively free from the shortcomings of the prior art. It will be apparent to those skilled in the art that modifications may be made without departing from the spirit and scope of the invention. Accordingly, it is not intended that the invention be limited except as may be necessary in view of the appended claims.

What is claimed is:

1. A load sensing assembly for sensing loads applied at a plurality of spaced locations around the perimeter of a closure, the sensing assembly comprising:

a plurality of spaced load sensors disposed on a substrate, with one of said load sensors adapted to be positioned proximate each of said spaced locations; and a layer of a compliant elastomeric material disposed on said sensing assembly and overlying each load sensor.

2. The load sensing assembly of claim 1, and wherein said layer of compliant material is disposed on said substrate in a continuous layer.

3. The load sensing assembly of claim 1, wherein each one of said plurality of load sensors comprises a pair of electrodes and a body of pressure sensitive resistive material between them.

4. The load sensing assembly of claim 3, wherein said assembly comprises first and second insulative substrates and a first electrode of each said pair is disposed on the inner surface of the first of said insulative substrates, and a second electrode of each pair is disposed on an inner surface of a second of said insulative substrates.

5. The load sensing assembly of claim 4, wherein a common conductive trace connects all of said first electrodes to a common terminal, and separate conductive traces connect each of said second electrodes to separate terminals.

6. The load sensing assembly of claim 4, wherein said layer of compliant elastomeric material is disposed on an outer surface of one of said substrates, and said layer overlies each said load sensor.

7. A pressure sensitive load sensing assembly for sensing loads applied at a plurality of spaced locations around the perimeter of a closure, the assembly comprising:

a plurality of spaced pressure sensitive load sensors, one for each of said spaced locations, each load sensor comprising a pair of electrodes and a body of pressure sensitive resistive material between them, one electrode of each said pair being on the inner surface of a first insulative substrate and the second electrode of each said pair being on an inner surface of a second insulative substrate, a common conductive trace connecting all of said first electrodes, and separate conductive traces for each of said second electrodes, and a terminal for each of said traces; and a layer of a compliant elastomeric material disposed on an outer surface of one of said substrates and overlying each of said load sensors.

8. The pressure sensitive sensing assembly of claim 7, wherein said first and second insulative substrates comprise plastic substrates.

9. The pressure sensitive sensing assembly of claim 8, wherein said plastic substrates comprise polyimide sheets.

10. The pressure sensitive sensing assembly of claim 7, wherein said compliant elastomeric layer comprises a high-temperature resistant silicone rubber.

11. The pressure sensitive sensing assembly of claim 7, and wherein said compliant elastomeric material layer is substantially coextensive with said insulative substrates.

12. The pressure sensitive sensing assembly of claim 11, wherein said compliant elastomeric layer has a thickness of from about 0.005 inch to about 0.020 inch.

13. The pressure sensitive sensing assembly of claim 7, wherein said load sensing assembly has a thickness of from about 0.010 inch to about 0.025 inch.

14. A sensor array for detecting tampering with the interior of an enclosure and cover assembly that are secured by a plurality of discrete fasteners, the sensor array comprising:

a first substrate having a plurality of first electrodes disposed thereon, with each of said first electrodes disposed in proximity to one of said discrete fasteners, and each of said first electrodes having a separate conductive trace extending therefrom;

a second substrate having a plurality of second electrodes disposed thereon, said second substrate overlying said first substrate such that each of said second electrodes confronts one of said first electrodes, and wherein each of said second electrodes shares a common conductive trace extending therefrom;

pressure sensitive resistive material disposed between confronting surfaces of each of said pairs of first and second electrodes thereby to form a plurality of load sensors between the inner surfaces of said substrates; and compliant elastomeric material layer disposed on the outer surface of one of said substrates and overlying said load sensors.

15. The sensor array of claim 14, further including means electrically connected to said traces, for measuring the electrical resistance of each of said plurality of load sensors.

16. The sensor array of claim 14, wherein said first and second substrates comprise thin plastic sheets.

17. The sensor array of claim 14, wherein each of said first electrode traces includes a conductive ink trace deposited on said first substrate.

18. The sensor array of claim 14, wherein each of said second electrodes is a portion of the common conductive trace, said common trace being deposited on the inner surface of said second substrate.

19. The sensor array of claim 14, wherein said sensor array has a thickness of from about 0.010 inch to about 0.025 inch.

20. The sensor array of claim 14, wherein said first substrate and said second substrate are held in a fixed, confronting relationship with respect to each other by an adhesive layer interposed between said substrates and around said first and second electrodes.

21. The sensor array of claim 14, wherein said compliant, elastomeric material comprises a relatively thin layer of a high-temperature silicone rubber.

22. The sensor array of claim 21, and wherein said compliant material is substantially coextensive with the surface of the substrate on which it is disposed.

23. A tamper-proof secure enclosure assembly comprising:

an enclosure, a cover secured to said enclosure by fasteners, and a sensor array;

said sensor array comprising a first substrate having a plurality of first electrodes disposed thereon, with each of said first electrodes disposed in proximity to one of said discrete fasteners, and each of said first electrodes having a separate conductive trace extending therefrom, a second substrate having a plurality of second electrodes disposed thereon, said second substrate overlying said first substrate such that each of said second electrodes confronts one of said first electrodes, and wherein each of said second electrodes shares a common conductive trace extending therefrom, pressure sensitive resistive material disposed between confronting surfaces of each of said pairs of first and second electrodes thereby to form a plurality of load sensors between the inner surfaces of said substrates and compliant elastomeric material layer disposed on the outer surface of one of said substrates and overlying said load sensors; and means within the enclosure for electrically connecting said traces to means for measuring the electrical resistance of each of said plurality of load sensors.

* * * * *